US008359700B1

(12) United States Patent
Zeidan

(10) Patent No.: US 8,359,700 B1
(45) Date of Patent: Jan. 29, 2013

(54) LOTTERY TICKET SCRATCHER

(76) Inventor: Sam S. Zeidan, East Rockaway, NY (US)

( * ) Notice: Subject to any disclaimer, the term of this patent is extended or adjusted under 35 U.S.C. 154(b) by 741 days.

(21) Appl. No.: 12/574,116

(22) Filed: Oct. 6, 2009

(51) Int. Cl.
*A47L 13/02* (2006.01)
*A47L 13/022* (2006.01)

(52) U.S. Cl. ..... 15/236.07; 15/236.01; D32/46; 30/169

(58) Field of Classification Search ..... 15/236.01, 15/236.07; 30/169, 123.7, 366; D32/46, D32/49; D7/693
See application file for complete search history.

(56) References Cited

U.S. PATENT DOCUMENTS 2,359,607 A * 10/1944 Bashara ..... 30/169
3,267,506 A * 8/1966 Van Patten ..... 15/236.07
4,316,326 A * 2/1982 Yeaton et al. ..... 30/366
4,646,382 A 3/1987 Smith
D290,056 S 5/1987 Hatfield
4,757,567 A 7/1988 Booker
5,129,157 A * 7/1992 Wood ..... 30/526
D341,455 S * 11/1993 Roma et al. ..... D32/49
D353,240 S * 12/1994 Naterman ..... D32/46
5,749,578 A 5/1998 Stacey
7,296,353 B1 * 11/2007 Jackson ..... 30/2
2002/0152572 A1 10/2002 Steinmetz et al.
2004/0025352 A1 * 2/2004 Vitucci ..... 30/123.5

* cited by examiner

*Primary Examiner* — Laura C Guidotti

(57) ABSTRACT

A lottery ticket scratcher device that permits a user to scratch off the "scratch-off" areas of a lottery game ticket, the device including a bulbous gripping end and a generally claw-shaped scraper portion having a gradually tapered forward edge that tapers into a sharp tip. A pressure member having a concave center portion is disposed on the upper surface of the scraper portion adjacent to an inside edge of the forward edge. The pressure member conforms to a user's digit tip to permit a user to apply pressure to the scraper portion to scratch off the "scratch-off" areas. An aperture integrated into the gripping end removably receives a key ring therethrough.

4 Claims, 2 Drawing Sheets

LOTTERY TICKET SCRATCHER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention is a new and improved lottery ticket scratcher device having a bulbous gripping end and an opposite claw-shaped scraper portion with an oval-shaped pressure member conforming to a user's digit tip disposed on top of the scratching end, the scratcher device attachable to a key ring to scratch off the material that covers various areas on a "scratch off" lottery game ticket.

SUMMARY OF THE INVENTION

The present invention is a new and improved lottery ticket scratcher device having a bulbous gripping end, which serves as a handle, and an opposite claw-shaped scraper portion with an oval-shaped pressure member disposed on a top side of the scraper portion. A forward edge of the scraper portion gradually tapers into a sharp tapered tip that provides extra scratching power to remove a covering over the scratch-off areas on a lottery ticket. The tapered tip permits fine-tuned removal of a covering over the scratch-off area of a lottery ticket thereby eliminating the possibility of the scratching off of an area that is too wide for a specific lottery game, thus preventing the invalidation of a winning ticket.

The pressure member conforms to a user's digit tip so that a user may press down on the pressure member to apply pressure to the scraper portion to easily scratch off the covering, typically formed of latex, that covers various "scratch off" areas on lottery game tickets. The device is attachable to a key ring. A small aperture for the key ring is integrated into the griping end rear portion. The bulbous gripping end is about one-half the size of a standard ping pong ball to allow a user to hold the gripping end between the user's digit tips. The entire device has a length of about 3 to 4 inches, a maximum width of about three-quarters of an inch at the device's widest point, and a height of about one and one-half inches.

The scratcher device may be fabricated from a heavy-duty molded plastic, metal, or a combination of plastic and metal. The device is provided is a wide variety of colors and patterns. The pressure member may also assume various shapes, as long as a center portion of the pressure member conforms to a user's digit tip. Each side of the scraper portion may bear a logo, as shown in FIG. 3. The logo may be a user's name, a corporate name, a team name, a trademarked name, another name, internet site address, website, or a graphic design.

To use the present lottery ticket scratcher device, the user grips the gripping end between two digit tips, presses down on the pressure member and applies the tapered tip to scratch off each covering as desired over a scratch-off area on a lottery ticket. Using the present device, a user is able to quickly determine if the ticket bears a winning combination without using the user's fingernails, coins, or similar make-shift devices to scratch off the lottery ticket.

The present lottery ticket scratcher device fulfills the need for a practical, handy item what is compact enough to be carried on a key ring, in a pocket, or in a purse to scratch off a covering of a scratch area on a lottery ticket. The present device is economically produced for reasonably inexpensive consumer pricing, yet is durable and is of reliable construction for many years of effective use.

The term "digit" means a user's fingers or thumb as used herein. The term "lottery ticket" is used interchangeably herein with the terms "lottery game ticket" and "ticket" all of which terms include within their meaning lottery ticket, instant game ticket, and other game tickets.

There has thus been outlined, rather broadly, the more important features of a lottery ticket scratcher that the detailed description thereof that follows may be better understood and in order that the present contribution to the art may be better appreciated. There are, of course, additional features of the lottery ticket scratcher that will be described hereinafter and which will form the subject matter of the claims appended hereto.

In this respect, before explaining at least one embodiment of the lottery ticket scratcher in detail, it is to be understood that the lottery ticket scratcher is not limited in its application to the details of construction and to the arrangements of the components set forth in the following description or illustrated in the drawings. The lottery ticket scratcher is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present lottery ticket scratcher. It is important, therefore, that the claims be regarded as including such equivalent constructions insofar as they do not depart from the spirit and scope of the present invention.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
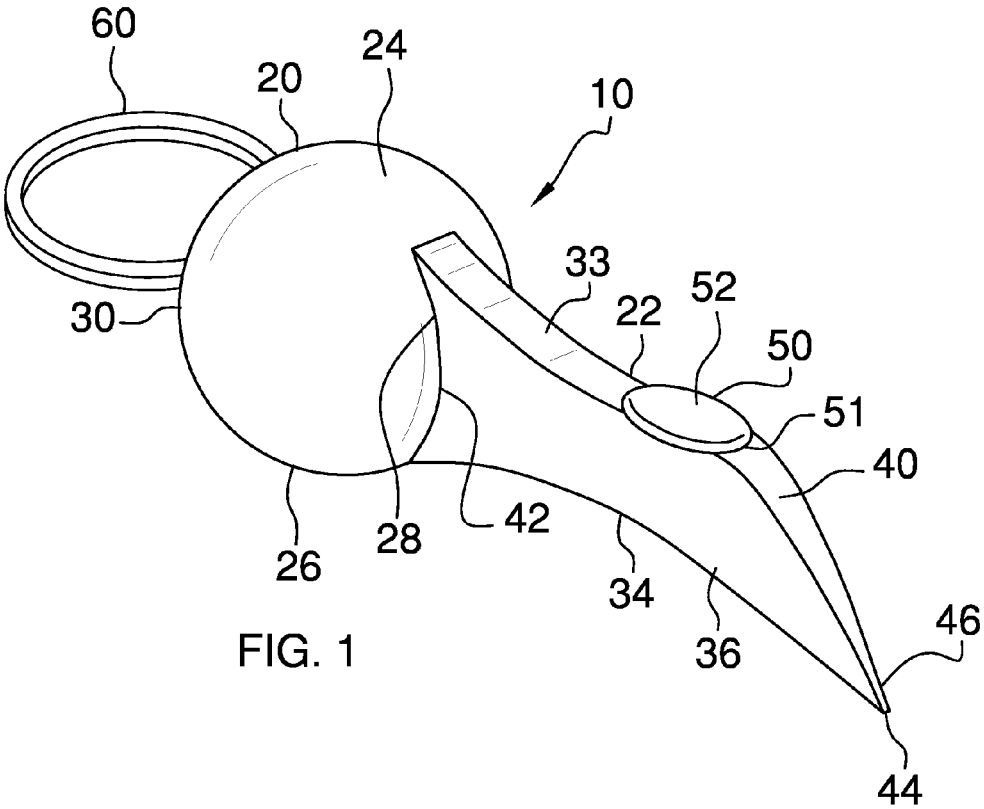
FIG. 1 is an isometric view of the lottery ticket scratcher.
Figure 2:
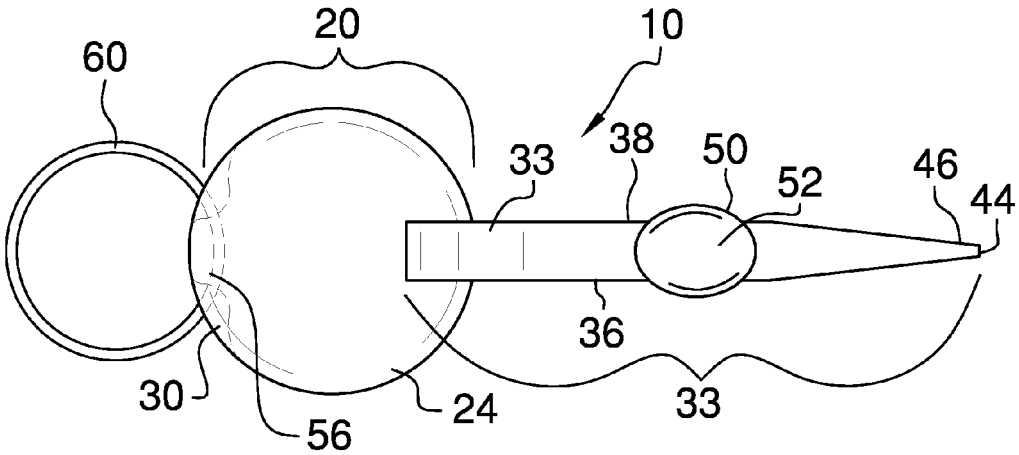
FIG. 2 is a top plan view thereof with a partial cross-section view of a rear portion.

With reference now to the drawings, and in particular to FIGS. 1 through 4 thereof, a new lottery ticket scratcher device embodying the principles and concepts of the present invention and generally designated by the reference numeral 10 will be described.

As best illustrated in FIGS. 1 through 4, the lottery ticket scratcher device 10 comprises a bulbous gripping end 20, which serves as a handle, and an opposite generally claw-shaped scraper portion 22. Furthermore, the gripping end 20 includes a top side 24, a bottom side 26, a front edge 28, and a substantially hemispherical rear portion 30 integrated within the gripping end 20, the rear portion 30 having an aperture 56 therethrough. The scraper portion 22 has a rectangular upper surface 33 when viewed from a top plan view, a slightly curved lower surface 34 when viewed from a side elevation view, a first side 36, a second side 38, a forward edge 40 and a concave rearward edge 42. The scraper portion 22 rearward edge 42 is conformingly attached to the gripping end 20 front edge 28. The forward edge 40 of the scraper portion 22 gradually tapers into a sharp tip 44 disposed on a front end 46 of the forward edge 40. The tip 44 when viewed from the top has a straight edge. The sharp tip 44 provides extra scratching power to remove a covering 80 over scratch-off areas 82 of a lottery ticket 84. When viewed from the side the forward edge 40 bends downwardly. The tapered tip 44 permits fine-tuned removal of the covering 80 over each scratch-off area 82 of a lottery ticket 84 thereby eliminating the possibility of the scratching off of an area that is too wide for a specific lottery game, thus preventing the invalidation of a winning ticket.

A pressure member 50, preferably oval-shaped, is disposed on the upper surface 33 of the scraper portion 22 adjacent to an inside edge 51 of the forward edge 40. The pressure member 50 has a slightly concave center portion 52.

The pressure member 50 conforms to a user's digit tip 49 so that a user may press down on the pressure member 50 to apply pressure to the scraper portion 22 to easily scratch off the covering 80, typically formed of latex, that covers various "scratch off" areas 82 on a lottery game ticket 84. The device 10 is attachable to a torus-shaped key ring 60. The small aperture 56 which removably receives a key ring 60 therethrough is integrated into the gripping end 20 rear portion 30.

The gripping end 20 is about one-half the size of a standard ping pong ball to allow a user to hold the gripping end 20 between the user's finger 92 and thumb 94. The present device 10 has a length of about 3 to 4 inches, a maximum width of about three-quarters of an inch at the device's widest point, and a height of about one and one-half inches.

Figure 3:
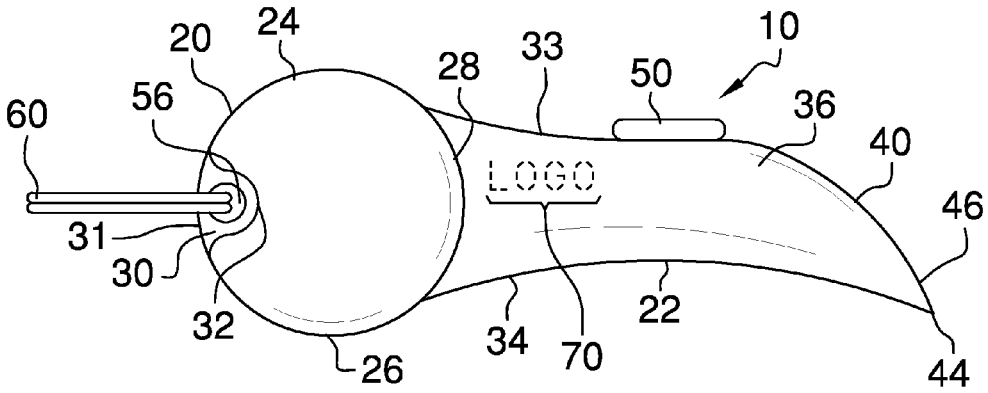
FIG. 3 is a right elevation view thereof, the opposite side being a mirror image thereof.
Figure 4:
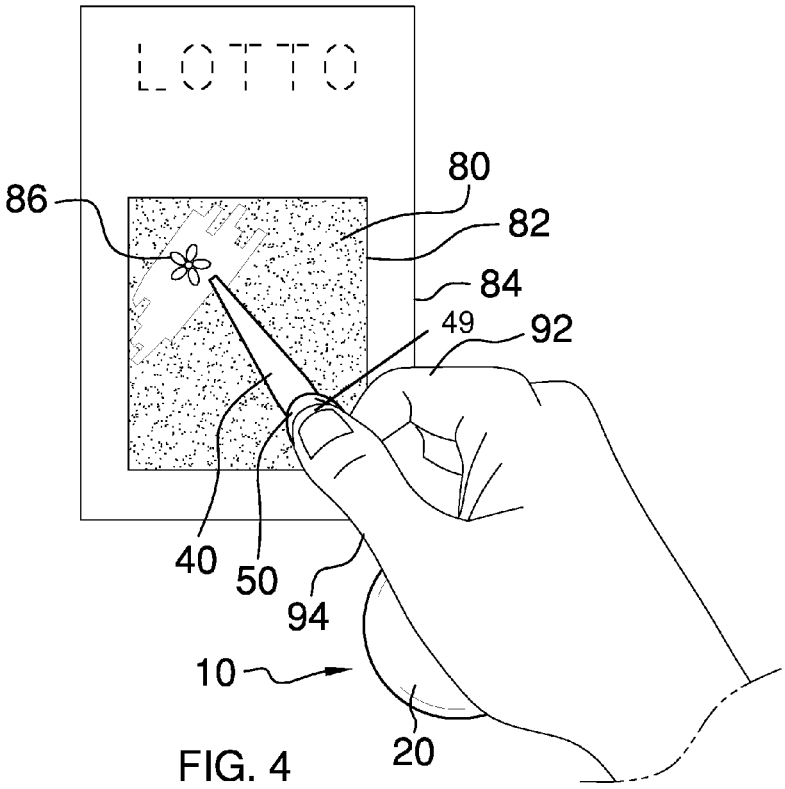
FIG. 4 is an in-use isometric view thereof illustrating use to scratch off a covering over a scratch off area of a lottery ticket.

The scratcher device 10 may be fabricated from a heavy-duty molded plastic, metal, or a combination of plastic and metal. The device 10 is provided in a wide variety of colors and patterns. The pressure member 50 is also provided in various shapes provided that the center portion 46 of the pressure member 50 conforms to a user's digit tip 49. Each of the first side 36 and second side 38 of the scraper portion 22 may bear a logo 70, as shown in FIG. 3. The logo 70 may be used for advertising or identification and may be a user's name, a corporate name, a team name, a trademarked name, another name, internet address, website, or a graphic design.

Operation:

To use the present lottery ticket scratcher device 10, the user grips the gripping end 20 between two digit tips 49, such as the tips of a forefinger 92 and thumb 94. Next, the user presses down on the pressure member 50 and applies the tip 44 to scratch off each covering 80 as the user desires over a scratch-off area 82 on a lottery ticket 84. Using the present device 10, a user is able to quickly determine if the ticket 84 bears indicia 86 a winning combination without using the user's fingernails, coins, or similar make-shift devices to scratch off the "scratch off" areas 82 of the lottery ticket 84. The indicia 86 shown under the scratch-off area 82 can easily be seen once the lottery ticket scratcher device 10 has been properly used. The user may also place a key ring 60 through the aperture 56 in the rear portion 30 of the gripping end 20.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A lottery ticket scratcher device comprising:

a bulbous gripping end comprising:

a top side;

a bottom side;

a front edge;

a substantially hemispherical rear portion;

an opposite generally claw-shaped scraper portion comprising:

a rectangular upper surface;

a slightly curved lower surface;

a first side;

a second side;

a gradually tapered, downwardly bending forward edge;

a sharp straight-edged tip disposed on a front end of the forward edge;

a concave rearward edge conformingly attached to the gripping end front edge;

a pressure member disposed on the upper surface of the scraper portion adjacent to an inside edge of the forward edge;

a slightly concave center portion of the pressure member;

wherein the pressure member conforms to a user's digit tip; and wherein the pressure member is oval-shaped.

2. The lottery ticket scratcher device of claim 1 wherein the device is about 3 to 4 inches in length, about ¾-inch wide at the device's widest point, and 1½ inches in height.

3. The lottery ticket scratcher device of claim 2 wherein the device is fabricated from a heavy-duty molded plastic.

4. The lottery ticket scratcher device of claim 2 wherein the device is fabricated from metal.

* * * * *